US010954463B2

(12) United States Patent
Yanagihara

(10) Patent No.: US 10,954,463 B2
(45) Date of Patent: Mar. 23, 2021

(54) LUBRICATING OIL COMPOSITION, LUBRICATING METHOD, AND TRANSMISSION

(71) Applicant: IDEMITSU KOSAN CO., LTD., Chiyoda-ku (JP)

(72) Inventor: Takashi Yanagihara, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/080,937

(22) PCT Filed: Mar. 1, 2017

(86) PCT No.: PCT/JP2017/008072
§ 371 (c)(1),
(2) Date: Aug. 29, 2018

(87) PCT Pub. No.: WO2017/159363
PCT Pub. Date: Sep. 21, 2017

(65) Prior Publication Data

US 2019/0010417 A1 Jan. 10, 2019

(30) Foreign Application Priority Data

Mar. 15, 2016 (JP) ..... JP2016-050752

(51) Int. Cl.

| | |
|---|---|
| ***C10M 133/16*** | (2006.01) |
| ***C10M 137/02*** | (2006.01) |
| ***C10M 137/04*** | (2006.01) |
| ***C10M 141/10*** | (2006.01) |
| ***C10M 163/00*** | (2006.01) |
| ***C10M 135/10*** | (2006.01) |
| *C10M 159/22* | (2006.01) |
| *C10M 159/24* | (2006.01) |
| *C10N 10/04* | (2006.01) |
| *C10N 30/02* | (2006.01) |
| *C10N 30/06* | (2006.01) |
| *C10N 30/00* | (2006.01) |
| *C10N 40/04* | (2006.01) |

(52) U.S. Cl.

CPC ..... *C10M 133/16* (2013.01); *C10M 135/10* (2013.01); *C10M 137/02* (2013.01); *C10M 137/04* (2013.01); *C10M 141/10* (2013.01); *C10M 163/00* (2013.01); *C10M 159/22* (2013.01); *C10M 159/24* (2013.01); *C10M 2203/1006* (2013.01); *C10M 2215/04* (2013.01); *C10M 2215/08* (2013.01); *C10M 2215/082* (2013.01); *C10M 2219/044* (2013.01); *C10M 2219/046* (2013.01); *C10M 2223/04* (2013.01); *C10M 2223/049* (2013.01); *C10N 2010/04* (2013.01); *C10N 2030/02* (2013.01); *C10N 2030/06* (2013.01); *C10N 2030/76* (2020.05); *C10N 2040/04* (2013.01); *C10N 2040/045* (2020.05)

(58) Field of Classification Search

CPC ..... C10N 2240/04; C10N 2010/04; C10N 2030/76; C10N 2030/06; C10N 2040/045; C10N 2040/04; C10M 2215/04; C10M 2219/044; C10M 2223/04; C10M 2223/049; C10M 2215/08

See application file for complete search history.

(56) References Cited

U.S. PATENT DOCUMENTS

| | | | |
|---|---|---|---|
| 2009/0312207 | A1 | 12/2009 | Bartley et al. |
| 2010/0144565 | A1 | 6/2010 | Ikeda et al. |
| 2011/0053816 | A1 | 3/2011 | Narita |
| 2012/0149619 | A1 | 6/2012 | Narita |
| 2014/0031268 | A1 | 1/2014 | Sumiejski et al. |

FOREIGN PATENT DOCUMENTS

| | | | |
|---|---|---|---|
| EP | 2 826 846 | A1 | 1/2015 |
| JP | 2001-288438 | A | 10/2001 |
| JP | 2009-511716 | A | 3/2009 |
| JP | 2009-167337 | A | 7/2009 |
| JP | 2010-513695 | A | 4/2010 |
| JP | 2011-190401 | A | 9/2011 |
| JP | 2013-189565 | A | 9/2013 |
| JP | 2001-323292 | A | 1/2014 |
| JP | 2014-501326 | A | 1/2014 |
| WO | WO 2011/037054 | A1 | 3/2011 |

OTHER PUBLICATIONS

International Search Report dated May 16, 2017, in PCT/JP2017/008072 filed Mar. 1, 2017.

Extended European Search Report dated Oct. 18, 2019 in European Patent Application No. 17766366.3 citing document AO therein, 8 pages.

Office Action dated Sep. 15, 2020 in corresponding Japanese Patent Application No. 2018-505799 (with English Translation), 7 pages.

*Primary Examiner* — Vishal V Vasisth

(74) *Attorney, Agent, or Firm* — Oblon, McClelland, Maier & Neustadt, L.L.P.

(57) ABSTRACT

Provided are a lubricating oil composition having a high intermetallic friction coefficient and having excellent clutch anti-shudder performance of excellent initial clutch anti-shudder performance and a long clutch anti-shudder lifetime, and a lubrication method and a transmission using the lubricating oil composition. The lubricating oil composition contains an amide compound (A) having a specific structure, a metal-based detergent (B), and at least one phosphorus acid ester (C) selected from an acid phosphate ester and an acid phosphite ester; and the lubrication method and the transmission use the lubricating oil composition.

14 Claims, No Drawings

LUBRICATING OIL COMPOSITION, LUBRICATING METHOD, AND TRANSMISSION

This application is a 371 of PCT/JP2017/008072, filed Mar. 1, 2017.

TECHNICAL FIELD

The present invention relates to a lubricating oil composition, and to a lubrication method and a transmission using the lubricating oil composition.

BACKGROUND ART

As transmissions for use in automobiles, manual transmissions, automatic transmissions, continuously variable transmissions and the like are now placed on the market, and special attention is paid to continuously variable transmissions for the reason that they are free from gear shift shock and from dropping down of engine revolutions in shifting up, and, can therefore improve acceleration performance. As continuously variable transmissions, metal belt-type ones, chain-type ones, toroidal-type ones and the like have been developed. A continuously variable transmission requires high-capacity power transmission by the friction coefficient between a belt or a chain and a pulley, and therefore the lubricating oil for use for these is required to have an intermetallic friction coefficient on a predetermined level or more.

These days further sophistication of continuously variable transmissions is being advanced, and those mounted with a lock-up clutch-attached torque converter have been developed. A torque converter transmits power while absorbing the differential rotation through stirring of a lubricating oil, and in any other than starting, the torque converter directly transmits power via a rock-up clutch to reduce energy loss. For rock-up clutch control, direct fastening may be combined with slip control for power transmission with slipping, and in such a case where the frictional properties of a lubricating oil are unsuitable, there may occur self-excited vibration called shudder. Accordingly, a lubricating oil is required to have clutch anti-shudder performance of both initial clutch anti-shudder performance and long-term clutch anti-shudder lifetime.

For example, there have been proposed a lubricating oil composition containing (a) an alkaline earth metal sulfonate or phenate, (b) an imide compound and (c) a phosphorus compound (see PTL 1), a lubricating oil composition produced by blending (A) at least one phosphorus-containing compound selected from phosphoric monoesters, phosphoric diesters and phosphorous monoesters having a hydrocarbon group having 1 or more and 8 or less carbon atoms, and (B) a tertiary amine compound having a substituent of a hydrocarbon group having 6 or more and 10 or less carbon atoms in a base oil (see PTL 2), and a lubricating oil composition produced by blending (A) a tertiary amine having a predetermined structure, (B) at least one of an acid phosphate and an acid phosphite, and (C) at least one of a metal sulfonate, a metal phenate and a metal salicylate in a lubricant base oil (see PTL 3). In addition, PTL 4 discloses a lubricating oil composition produced by blending (A) a primary amine, (B) a tertiary amine, (C) at least one of a metal sulfonate, a metal phenate and a metal salicylate, and (D) at least any one of an acid phosphate and an acid phosphite in a lubricant base oil and PTL 5 discloses a lubricant additive containing an amide compound having an alkyl group having 16 to 22 carbon atoms in the molecule.

CITATION LIST

Patent Literature

PTL 1: JP 2001-288488 A
PTL 2: JP 2009-167337 A
PTL 3: WO2011/037054
PTL 4: JP 2013-189565 A
PTL 5: JP 2011-190401 A

SUMMARY OF INVENTION

Technical Problem

Recently for a torque converter, fastening region enlargement and slip control have come to be much used for further energy loss reduction. Consequently, the frictional work or a rock-up clutch increases, and improvement of clutch anti-shudder performance of both initial clutch anti-shudder performance and long-term clutch anti-shudder lifetime has become required more and more.

However, the lubricating oil compositions described in PTLs 1 to 3 could not be said to be satisfactory in point of clutch anti-shudder performance. The lubricating oil compositions described in PTLs 4 and 5 are to attain both a high intermetallic friction coefficient and a long clutch anti-shudder lifetime, but could not be said to sufficiently satisfy both the requirements of a high intermetallic friction coefficient and a long clutch anti-shudder lifetime that have become severer these days.

The present invention has been made in consideration of the above-mentioned situation, and objects thereof are to provide a lubricating oil composition having a high intermetallic friction coefficient and having excellent clutch anti-shudder performance to satisfy both excellent initial clutch anti-shudder performance and long-term clutch anti-shudder lifetime, and to provide a lubrication method and a transmission using the lubricating oil composition.

Solution to Problem

As a result of assiduous studies, the present inventors have found that the present invention mentioned below can solve the above-mentioned problems. Specifically, the present invention provides a lubricating oil composition having the constitution mentioned below, and a lubrication method and a transmission using the lubricating oil composition.

1. A lubricating oil composition containing an amide compound (A) represented by the following general formula (I), a metal-based detergent (B), and at least one phosphorus acid ester (C) selected from an acid phosphate ester and an acid phosphite ester, wherein the content of the hydrocarbon group having 12 carbon atoms in all $R^1$'s and $R^2$'s contained in the amide compound is 30% by mass or more and 75% by mass or less, and the content of the hydrocarbon group having 14 carbon atoms therein is 5% by mass or more and 40% by mass or less:

(I)

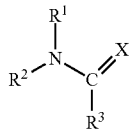

wherein $R^1$ and $R^2$ each independently represent a hydrocarbon group having 6 or more carbon atoms. $W^3$ represents a hydroxyalkyl group having 1 or more and 6 or less carbon atoms, or a group formed through condensation of the hydroxyalkyl group and an acylating agent, and X represents an oxygen atom or a sulfur atom.

2. A lubrication method using the lubricating oil composition of the above 1.

3. A transmission using the lubricating oil composition of the above 1.

Advantageous Effects of Invention

According to the present invention, there can be provided a lubricating oil composition having a high intermetallic friction coefficient and having excellent clutch anti-shudder performance to satisfy both excellent initial clutch anti-shudder performance and long-term clutch anti-shudder lifetime, and a lubrication method and a transmission using the lubricating oil composition.

DESCRIPTION OF EMBODIMENTS

Hereinunder, embodiments of the present invention (also referred to as the present embodiments) are described. In this description, the numerical values relating to "or more" and "or less" may be combined in any manner.

[Lubricating Oil Composition]

The lubricating oil composition for transmissions of the present embodiment contains an amide compound (A) represented by the above-mentioned general formula (I), a metal-based detergent (B), and at least one phosphorus acid ester (C) selected from an acid phosphate ester and an acid phosphite ester, wherein the content of the hydrocarbon group having 12 carbon atoms in all $R^1$'s and $R^2$'s contained in the amide compound is 30% by mass or more and 75% by mass or less, and the content of the hydrocarbon group having 14 carbon atoms therein is 5% by mass or more and 40% by mass or less.

<Amide Compound (A)>

The amide compound (A) is an amide compound represented by the following general formula (I), and the content of the hydrocarbon group having 12 carbon atoms in all $R^1$'s and $R^2$'s contained in the amide compound is 30% by mass or more and 75% by mass or less, and the content of the hydrocarbon group having 14 carbon atoms therein is 5% by mass or more and 40% by mass or less. In the present embodiment, when the amide compound (A) is not contained, a high intermetallic friction coefficient and excellent, clutch anti-shudder performance could not be attained.

(I)

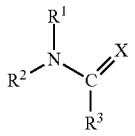

In the general formula (I), $R^1$ and $R^2$ each independently represent a hydrocarbon group having 6 or more carbon atoms. The hydrocarbon group includes an alkyl group, an alkenyl group, an alkadiene group, a cycloalkyl group, an aryl group and an arylalkyl group. Among these hydrocarbon groups, an alkyl group, an alkenyl group, and an alkadiene group are preferred, and especially from the viewpoint of enhancing the stability of the amide compound to attain a more excellent effect, an alkyl group is more preferred. $R^1$ and $R^2$ may be the same or different, and the hydrocarbon group may be linear, branched or cyclic.

In the present embodiment, the carbon number of the hydrocarbon group of $R^1$ and $R^2$ must be 6 or more. When the carbon number is not 6 or more, a high intermetallic friction coefficient and excellent clutch anti-shudder performance could not be attained. From the viewpoint of attaining a high intermetallic friction coefficient and excellent clutch anti-shudder performance, the carbon number is preferably 7 or more, more preferably 1 or more. The upper limit of the carbon number is preferably 24 or less, more preferably 22 or less, even more preferably 20 or less.

Examples of the alkyl group include various hexyl groups such as an n-hexyl group, an iso-hexyl group, an s-hexyl group, and a t-hexyl group (hereinunder functional groups having a predetermined carbon number and including linear and branched ones and isomers thereof may be abbreviated as various functional groups), various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl groups, various tricosyl groups, and various tetracosyl groups.

Examples of the alkenyl group include various hexenyl groups, various heptenyl groups, various octenyl groups, various nonenyl groups, various decenyl groups, various undecenyl groups, various dodecenyl groups, various tridecenyl groups, various tetradecenyl groups, various pentadecenyl groups, various hexadecenyl groups, various heptadecenyl groups, various octadeconyl groups, various nonadeceyl groups, various eicosenyl groups, various heneicosenyl groups, various docosenyl groups, various tricosenyl groups, and various tetracosenyl groups.

Examples of the alkadiene group include various hexadiene groups, various heptadiene groups, various octadiene groups, various nonadiene groups, various decadiene groups, various undecadiene groups, various dodecadiene groups, various tridecadiene groups, various tetradecadiene groups, various pentadecadiene groups, various hexadecadiene groups, various heptadecadiene groups, various octadecadiene groups, various nonadecadiene groups, various eicosadiene groups, various heneicosadiene groups, various docosadiene groups, various tricosadiene groups, and various tetracosadiene groups.

Examples of the cycloalkyl group include a clohexyl group, various methylcyclohexyl groups, various ethylcyclohexyl groups, and various dimethylcyclohexyl groups; the aryl group includes a phenyl group, various methylphenyl groups, various ethylphenyl groups, various dimethylphenyl groups, various propylphenyl groups, various trimethethylphenyl groups, various butylphenyl groups and various naphthyl groups; the arylalkyl group includes a benzyl group, a phenethyl group, various phenylpropyl groups, various phenylbutyl groups, various methylbenzyl groups, various ethylbenzyl groups, various propylbenzyl groups, various butylbenzyl groups, and various hexylbenzyl groups.

The hydroxyalkyl group having 1 or more and 6 or less carbon atoms of $R^3$ includes a hydroxymethyl group, a hydroxyethyl group, various hydroxypropyl groups, various hydroxybutyl groups, various hydroxypentyl groups, and various hydroxyhexyl groups. The alkyl group contained in the hydroxyalkyl group may be any of linear, branched or cyclic ones.

The carbon number of $R^3$ is 1 or more and 6 or less. When the carbon number of $R^3$ does not fall within the above-mentioned range, a high intermetallic friction coefficient and excellent clutch anti-shudder performance could not be attained. Among these, from the viewpoint of attaining a high intermetallic friction coefficient and excellent clutch anti-shudder performance, the carbon number is preferably 5 or less, more preferably 4 or less, even more preferably 2 or less, and the lower limit may be 1 or more.

$R^3$ includes a group formed through condensation of a hydroxyalkyl group and an acylating agent. The acylating agent includes carboxylic acid compounds such as carboxylic acids such as formic acid, acetic acid, succinic acid, and salicylic acid, halides thereof, and anhydride thereof; and thiocarboxylic acid compounds such as thiocarboxylic acids such as thioacetic acid, thiopropionic acid and phenylthioacetic acid, and anhydrides thereof.

From the viewpoint of attaining a high intermetallic friction coefficient and excellent clutch anti-shudder performance, $R^3$ is preferably a hydroxyalkyl group.

Regarding $R^1$ and $R^2$ in the general formula (I) that expresses the amide compound (A), the content of the hydrocarbon group having 12 carbon atoms among all $R^1$'s and $R^2$'s contained in the amide compound needs to be 30% by mass or more and 75% by mass or less, and the content of the hydrocarbon group having 14 carbon atoms therein needs to be 5% by mass or more and 40% by mass or less. When the content of the hydrocarbon having a carbon number of 12 and 14 does not fall within the above-mentioned range, a high intermetallic friction coefficient and excellent clutch anti-shudder performance could not be attained. Here, "all $R^1$'s and $R^2$'s" means the entire amount (the total amount) of $R^1$'s and $R^2$'s in the amide compound represented by the general formula (I). Accordingly, the "content of the hydrocarbon group having 12 carbon atoms in all $R^1$'s and $R^2$'s" means the content of the hydrocarbon group having 12 carbon atoms contained as at least one of $R^1$ and $R^2$, based on the entire amount (total amount) of $R^1$'s and $R^2$'s, in the amide, compound represented by the general formula (I). For example, in the case where plural kinds of amide compounds represented by the general formula (I) are used, the entire amount (the total amount) of $R^1$ and $R^2$ contained in all the amide compounds as combined is meant to indicate "all $R^1$'s and $R^2$'s", and the content of the hydrocarbon group having 12 carbon atoms contained as at least any one of $R^1$ and $R^2$ is meant to indicate the "content of the hydrocarbon atoms having 12 carbon atoms in all $R^1$'s and $R^2$'s".

From the viewpoint of attaining a high intermetallic friction coefficient and excellent clutch anti-shudder performance, the content of the hydrocarbon group having 12 carbon atoms in all $R^1$'s and $R^2$'s is preferably 33% by mass or more, more preferably 35% by mass or more, even more preferably 40% by mass or more. The upper limit is preferably 70% by mass or less, more preferably 68% by mass or less, even more preferably 65% by mass or less. The content of the hydrocarbon group having 14 carbon atoms is preferably 7% by mass or more, more preferably 10% by mass or more, even more preferably 13% by mass or more. The upper limit is preferably 35% by mass or less, more preferably 30% by mass or less, even more preferably 25% by mass or less.

When the content of the hydrocarbon group having a carbon number of 12 and 14 in all $R^1$'s and $R^2$'s in the amide compound (A) falls within the above-mentioned range, these hydrocarbon groups may exist in any state in $R^1$ and $R^2$. For example, regarding the amide compound (A), $R^1$ and $R^2$ therein may have any carbon number of 12 and 14 like one having a hydrocarbon group having 12 carbon atoms as $R^1$ and having a hydrocarbon group having 14 carbon atoms as $R^2$, or one having a hydrocarbon group having 12 carbon atoms as $R^1$ and having a hydrocarbon group having 12 carbon atoms as $R^2$, or any one of $R^1$ and $R^2$ therein may be any, of a hydrocarbon group having a carbon number of 12 and 14 like one having a hydrocarbon group having 16 carbon atoms as $R^1$ and having a hydrocarbon group having 14 carbon atoms as $R^2$. In addition, the amide compound (A) includes an amide compound of the general formula (I) where $R^1$ and $R^2$ are neither a hydrocarbon group, having 12 carbon atoms nor a hydrocarbon group having 14 carbon atoms.

As in the above, plural kinds of compounds represented by the general formula (I) may be combined for use for the amide compound (A), and for example, plural kinds of amide compounds of the general formula (I) where $R^1$ and $R^2$ are the same or different hydrocarbon groups may be combined for use herein.

From the viewpoint of attaining a high inter metallic friction coefficient and excellent clutch anti-shudder performance, it is preferred that $R^1$ and $R^2$ in the amide compound (A) include an alkyl group having 12 carbon atoms (dodecyl group) and an alkyl group having 14 carbon atoms (tetradecyl group) and, in all $R^1$'s and $R^2$'s, the content of a dodecyl group is 30% by mass or more and 75% by mass or less, and the content of a tetradecyl group is 5% by mass or more and 40% by mass or less.

From the same viewpoint as above, it is preferred that the amide compound (A) contains, as the alkyl group therein, a dodecyl group, a tetradecyl group and at least one selected from an octyl group, a decyl group, a hexadecyl group, an octadecyl group and an octadecenyl group, and, in all $R^1$'s and $R^2$'s, the content of a dodecyl group is 30% by mass or more and 75% by mass or less, the content of a tetradecyl group is 5% by mass or more and 40% by mass or less, and the content of at least one selected from an octyl group, a decyl group, a hexadecyl group, an octadecyl group and an octadecenyl group is 1% by mass or more and 20% by mass or less.

X represents an oxygen atom or a sulfur atom. When X is not an oxygen atom or a sulfur atom, a high intermetallic friction coefficient and excellent clutch anti-shudder performance could not be attained. From the viewpoint of attaining a high intermetallic friction coefficient and excellent clutch anti-shudder performance, X is preferably an oxygen atom. The amide compound (A) includes both an amide compound where X is an oxygen atom and a thioamide compound where X is a sulfur atom, but an amide compound where X is an oxygen atom is preferred.

Examples of the amide compound represented by the general formula (I) include a reaction product using a secondary amine, more specifically a reaction product of a secondary amine and at least one selected from a hydroxycarboxylic acid and a hydroxythiocarboxylic acid.

The secondary amine may be a secondary amine having a hydrocarbon group exemplified hereinabove as $R^1$ and $R^2$. The hydroxycarboxylic acid and the hydroxythiocarboxylic acid include those having a hydroxyalkyl group exemplified hereinabove as $R^3$, and preferred examples thereof include hydroxycarboxylic acids such as hydroxy acetic acid (glycolic acid), various hydroxypropanoic acids, various hydroxybutanic acids, various hydroxypentanoic acids, various hydroxyhexanoic acids, and various hydroxyheptanoic acids; and hydroxythiocarboxylic acids such as various hydroxypropanethioic acids, various hydroxyhexanethioic acids various hydroxypentanethioic acids, various hydroxyhexanethioic acids, and various hydroxyheptanethioic acids. Hydroxycarboxylic acids are more preferred.

Examples of the secondary amine usable herein include vegetable-derived secondary amines such as dicocoalkylamines obtainable from coconut, such as those containing at least a hydrocarbon group having 12 carbon atoms and a hydrocarbon group having 14 carbon atoms.

More specifically, the vegetable-derived secondary amine preferably includes a secondary amine containing a hydrocarbon group having 12 carbon atoms in an amount of 30% by mass or more and 75% by mass or less, and containing a hydrocarbon group having 14 carbon atoms in an amount of 5% by mass or more and 40% by mass or less; more preferably a secondary amine where the hydrocarbon, group having 12 carbon atoms is a dodecyl group and the hydrocarbon group having 14 carbon atoms is a tetradecyl group; even more preferably a secondary amine containing a dodecyl group and a tetradecyl group, and at least one selected from an octyl group, a decyl group, a hexadecyl group, an octadecyl group and an octadecenyl group; and especially preferably a secondary amine containing a dodecyl group and a tetradecyl group, and at least one selected from an octyl group, a decyl group, a hexadecyl group, an octadecyl group and an octadecenyl group, and containing a dodecyl group in an amount of 30% by mass or more and 75% by mass or less, a tetradecyl group in an amount of 5% by mass or more and 40% by mass or less, and at least one selected from an octyl group, a decyl group, a hexadecyl group, an octadecyl group and an octadecenyl group in an amount of 1% by mass or more and 20% by mass or less.

As the secondary amine, a tallow-derived one is also usable herein, and examples thereof include those mainly having an ethylhexyl group having 8 carbon atoms and an octadecyl group having 18 carbon atoms. In these cases, the amide compounds to be obtained include plural kinds of the amide compounds represented by the general formula (I) where $R^1$ and $R^2$ are the same or different hydrocarbon groups. In the case where a vegetable-derived or tallow-derived one is used as the secondary amine, it may contain a primary amine and a tertiary amine as the case may be, and can contain them as long as the advantageous effects of the present invention are not detracted.

The amide compound (A) is preferably an amide compound represented by the general formula (I) where $R^1$ and $R^2$ each are an alkyl group having 6 or more and 24 or less carbon atoms, and containing a dodecyl, group and a tetradecyl group each in a predetermined amount, $R^3$ is a hydroxyalkyl group having 1 or more and 2 or less carbon atoms, and X is an oxygen atom.

Also preferably, the amide compound is an amide compound of a reaction product using a vegetable-derived secondary amine such as coconut, especially a reaction product using the secondary amine and a hydroxyacetic acid as a hydroxycarboxylic acid, specifically, an amide compound of the above-mentioned general formula (I) where $R^1$ and $R^2$ contain a dodecyl group and a tetradecyl group, and at least one selected from an octyl group, a decyl group, a hexadecyl group, an octadecyl group and an octadecenyl group each in a predetermined amount, $R^3$ is a hydroxymethyl group having 1 carbon atom, and Y is an oxygen atom.

The content of the amide compound (A), based on the total amount of the composition, is preferably 100 ppm by mass or more as the nitrogen content derived from the amide compound (A), more preferably 150 ppm by mass or more, even more preferably 200 ppm by mass or more. The upper limit is 1,000 ppm by mass or less, more preferably 800 ppm by mass or less, even more preferably 600 ppm by mass or less. When the content of the amide compound (A) falls within the above range, a high intermetallic friction coefficient and excellent clutch anti-shudder performance can be attained efficiently.

For the same reason as above, the content of the amide compound, based on the total amount of the composition, is preferably 0.1% by mass or more, more preferably 0.3% by mass or more, even more preferably 0.5% by mass or more. The upper limit is preferably 3% by mass or less, more preferably 2.5% by mass or less, even more preferably 2% by mass or less.

<Metal-Based Detergent (B)>

When used in combination with the amide compound (A), the metal-based detergent (B) may impart a high intermetallic friction coefficient and excellent clutch anti-shudder performance to the lubricating oil composition of the present embodiment. In the present embodiment, when the metal-based detergent (B) is not contained, a high intermetallic friction coefficient and excellent clutch anti-shudder performance could not be attained. Preferably, the metal-based detergent (B) includes at least one selected from metal sulfonates, metal phenates and metal salicylates.

As the metal contained in these metal-based detergents, an alkali metal such as sodium and potassium, and an alkaline earth metal such as magnesium, calcium and barium are preferred; an alkaline earth metal such as magnesium, calcium and barium is more preferred; and calcium is even more preferred.

The base number of the metal-based detergent (B) is preferably 10 mgKOH/g or more, more preferably 50 mgKOH/g or more, even more preferably 150 mgKOH/g or more. The upper limit is preferably 700 mgKOH/g or less, more preferably 600 mgKOH/g or less, even more preferably 550 mgKOH/g or less. When the base number falls within the above range, a high intermetallic friction coefficient and excellent clutch anti-shudder performance can be attained. In this description, the base number is a total base number measured according to the perchloric acid method described in JIS K2501:2003.

The metal sulfonate among the metal-based detergent (B) includes an alkali metal salt and an alkaline metal salt of an alkylaromatic sulfonic acid obtained through sulfonation of an alkylaromatic compound having a mass-average molecular weight of preferably 300 or more and 1,500 or less, more preferably 350 or more and 1,000 or less, even more preferably 400 or more and 700 or less. A method for measuring the mass-average molecular weight will be described below.

The metal phenate includes an alkali metal salt and an alkaline earth metal salt of an alkylphenol, an alkylphenol sulfide or a Mannich reaction product of an alkylphenol. The metal salicylate includes an alkali metal salt and an alkaline earth metal salt of an alkylsalicylic acid.

The alkyl group constituting these metal-based detergents is preferably an alkyl group having 4 or more and 30 or less carbon atoms, more preferably 5 or more and 24 or less carbon atoms, even more preferably 6 or more and 18 or less carbon atoms, and the alkyl group may be any of a linear or branched one.

The content of the metal-based detergent (B) based on the total amount of the composition is, as the content of the metal derived from the metal-based detergent (B), preferably 10 ppm by mass or more, more preferably 100 ppm by mass or more, even more preferably 300 ppm by mass or more. The upper limit is preferably 1,000 ppm by mass or less, more preferably 800 ppm by mass or less, even more preferably 700 ppm by mass or less. When the content of the metal-based detergent (B) falls within the above range, a high intermetallic friction coefficient and excellent clutch anti-shudder performance can be attained efficiently along with detergency.

For the same reason as above, the content of the metal-based detergent (B) based on the total amount of the composition is preferably 0.05% by mass or more, more, preferably 0.1% by mass or more, even more preferably 0.2% by mass or more. The upper limit is preferably 2% by mass or less, more preferably 1.5% by mass or, less, even more preferably 1% by mass or less.

<Phosphorus Acid Ester (C)>

The phosphorus acid ester (C) is at least one selected from an acid phosphate ester and an acid phosphite ester. When the phosphorus acid ester (C) is contained, an especially high intermetallic friction coefficient can be attained, and in addition, owing to the interaction with the other components, namely the amide compound (A) and the metal-based detergent (B), a high intermetallic friction coefficient and excellent clutch anti-shudder performance can be attained.

Preferred examples of the acid phosphate ester include those represented by the following general formulae (II) and (III), and preferred examples of the acid phosphite ester include those represented by the following general formula (IV) and (V).

(II)

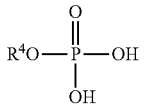

(III)

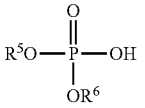

(IV)

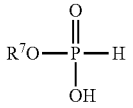

(V)

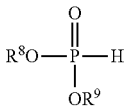

In the general formulae (II) to (V), $R^4$ to $R^9$ to each independently represent a hydrocarbon group having 1 or more and 16 or less carbon atoms. The hydrocarbon group includes an alkyl group, an alkenyl group, a cycloalkyl group, an aryl group and an arylalkyl group. Among these hydrocarbon groups, an alkyl group and an alkenyl group are preferred, and especially from the viewpoint of enhancing the stability of the amide compound to attain a more excellent effect, an alkyl group is more preferred. $R^5$ and $R^6$ in the general formula (III) may be the same as or different from $R^8$ and $R^9$ in the general formula (V). The hydrocarbon group may be any of a linear, branched or cyclic one.

More specifically, the hydrocarbon group of $R^4$ to $R^9$ includes an alkyl group such as a methyl group, an ethyl group, various propyl groups, various butyl groups, various pentyl groups, various hexyl groups, various heptyl groups, various octyl groups, various nonyl groups, various decyl groups, various undecyl groups, and various dodecyl groups; and an alkenyl group such as a vinyl group, various propenyl groups, various butenyl groups, various pentenyl groups, various hexenyl groups, various heptenyl groups, various octenyl groups, various nonenyl groups, various decenyl groups, various undecenyl groups, and various dodecenyl groups. As the cycloalkyl group, the aryl group and the arylalkyl group, those exemplified, hereinabove for the cycloalkyl group, the aryl group and the arylalkyl group of $R^1$ and $R^2$ are preferred.

From the viewpoint of attaining a high intermetallic friction coefficient and excellent clutch anti-shudder performance, the carbon number of the alkyl group and the alkenyl group is preferably 2 or more, more preferably 3 or more, even more preferably 4 or more. The upper limit is preferably 14 or less, more preferably 13 or less, even more preferably 12 or less. The carbon number of the cycloalkyl group and the aryl group is preferably 6 or more, and the upper limit is preferably 14 or less, more preferably 13 or less, even more preferably 12 or less. The carbon number of the arylalkyl group is preferably 7 or more, and the upper limit is preferably 14 or less, more preferably 13 or less, even more preferably 12 or less.

Examples of the acid phosphate monoester represented by the general formula (II) include ethyl acid phosphate ester, propyl acid phosphate ester, butyl acid phosphate ester and ethylhexyl acid phosphate ester. Examples of the acid phosphate diester represented by the general formula (III) include, diethyl acid phosphate ester, dipropyl acid phosphate ester, dibutyl acid phosphate ester, and diethylhexyl acid phosphate ester.

Among the above-mentioned acid phosphate esters, an acid phosphate monoester having an alkyl group having 6 or more and 8 or less carbon atoms is preferred from the viewpoint of attaining a higher intermetallic friction coefficient, an acid phosphate monoester having a branched alkyl group is more preferred, and an acid phosphate monoester having a branched alkyl group having 8 carbon atoms, for example, ethylhexyl acid phosphate ester is more preferred.

Examples of the acid phosphite monoester represented by the general formula (IV) include ethyl hydrogenphosphite, propyl hydrogenphosphite, butyl hydrogenphosphite, and ethylhexyl hydrogenphosphite. Examples of the acid phosphite diester represented by the general formula (V) include dihexyl hydrogenphosphite, diheptyl hydrogenphosphite, dioctyl hydrogenphosphite, and diethylhexyl hydrogenphosphite.

Among the above-mentioned acid phosphite esters, acid phosphite ester monoesters having an alkyl group having 6 or more and 8 or less carbon atoms are preferred from the viewpoint of attaining a higher intermetallic friction coefficient, acid phosphite monoesters having a branched alkyl group are more preferred, and acid phosphite monoesters having a branched alkyl group having 8 carbon atoms, for example, ethylhexyl hydrogenphosphite are even more preferred.

The content of the phosphorus acid ester (C) based on the total amount of the composition is, as the content of phosphorus derived from the phosphorus acid ester (C), preferably 100 ppm by mass or more, more preferably 150 ppm by mass or more, even more preferably 200 ppm by mass or more. The upper limit is preferably 1,000 ppm by mass or less, more preferably 800 ppm by mass or less, even more preferably 700 ppm by mass or less. When the content of the phosphorus acid ester (C) falls within the above range, a high intermetallic friction coefficient and excellent clutch anti-shudder performance can be attained efficiently along with detergency.

For the same reason as above, the content of the phosphorus acid ester (C) based on the total amount of the composition is preferably 0.05% by mass or more, more preferably 0.1% by mass or more, even more preferably 0.15% by mass or more. The upper limit is preferably 2% by mass or less, more preferably 1.5% by mass or less, even more preferably 1% by mass or less.

<(D) Base Oil>

The lubricating oil composition of the present embodiment may further contain a base oil (D). The base oil (D) may be a mineral oil or a synthetic oil.

The mineral oil includes topped crudes obtained through atmospheric distillation of crude oils such as paraffin base crude oils, naphthene base crude oils or intermediate base crude oils; distillates obtained through vacuum distillation of such topped crudes; mineral oils obtained by purifying the distillates through one or more purification treatments of solvent deasphalting, solvent extraction, hydrocracking, solvent dewaxing, catalytic dewaxing or hydrorefining, for example, light neutral oils, medium neutral oils, heavy neutral oils, and bright stocks; and mineral oils obtained by isomerizing wax produced through Fischer-Tropsch synthesis (GTL wax).

As the mineral oil, those grouped in any of Groups 1, 2 and 3 in the base oil category by API (American Petroleum Institute) may be used, but those grouped in Groups 2 and 3 are preferred from the viewpoint of more effectively preventing sludge formation and the viewpoint of attaining good viscosity characteristics and stability against oxidation degradation.

Examples of the synthetic oil include poly-α-olefins such as polybutene, ethylene-α-olefin copolymers, and α-olefin homopolymers or copolymers; various esters such as polyol esters, dibasic acid esters, and phosphate esters; various ethers such as polyphenyl ethers; polyglycols; alkylbenzenes; and alkylnaphthalenes.

As the base oil (D), one of the above-mentioned mineral oils may be used alone or plural kinds thereof may be used in combination, or one of the synthetic oils may be used alone or plural kinds thereof may be used in combination. One or more kinds of mineral oils and one or more kinds of synthetic oils may be combined to give a mixed oil for use herein.

The viscosity of the base oil (D) is not specifically limited. Preferably, the kinematic viscosity thereof at 100° C. is 1.5 $mm^2/s$ or more, more preferably 2 $mm^2/s$ or more, even more preferably 2.5 $mm^2/s$ or more, and especially preferably 3 $mm^2/s$ or more. The upper limit is preferably 10 $mm^2/s$ or less, more preferably 8 $mm^2/s$ or less, even more preferably 7 $mm^2/s$ or less, and especially preferably 6 $mm^2/s$ or less. The kinematic viscosity at 40° C. of the base oil (D) is preferably 7 $mm^2/s$ or more, more preferably 8 $mm^2/s$ or more, even more preferably 10 $mm^2/s$ or more. The upper limit is preferably 25 $mm^2/s$ or less, more preferably 24 $mm^2/s$ or less, even more preferably 23 $mm^2/s$ or less. When the kinematic viscosity of the base oil (D) fails within the above range, fuel saving performance may be bettered and a high intermetallic friction coefficient and excellent clutch anti-shudder performance can be attained.

Also from the same viewpoint as above, the viscosity index of the base oil (D) is preferably 80 or more, more preferably 90 or more, even more preferably 100 or more. In this description, the kinematic viscosity and the viscosity index are values measured using a glass capillary viscometer according to JIS K 2283:2000.

The content of the base oil (D) based on the total amount of the composition is generally 50% by mass or more, preferably 60% by mass or more, more preferably 70% by mass or more, even more preferably 80% by mass or more. The upper limit is preferably 97% by mass or less, more preferably 95% by mass or less, even more preferably 93% by mass or less.

<Other Additives)

The lubricating oil composition of the present embodiment may contain any other additives than the amide compound (A), the metal-based detergent (B), the phosphorus acid ester (C) and the optional component of the base oil (D), as long as the object of the present invention is not detracted, and for example, any other additives such as a viscosity index improver, a friction modifier, a friction inhibitor, a dispersant, a metal deactivator, an antioxidant, a flow point depressant, and an anti-foaming agent may be suitably selected and blended in the composition. One alone of these additives may be used or plural kinds thereof may be used in combination. The lubricating oil composition of the present embodiment may be composed of the above-mentioned amide compound (A), the metal-based detergent (B) and the phosphorus acid ester (C), or may be composed of the amide compound (A), the metal-based detergent (B), the phosphorus acid ester (C) and the base oil (D), or may be composed of the amide compound (A), the metal-based detergent (B), the phosphorus acid ester (C) and other additives, or may be composed of the amide compound (A), the metal-based detergent (B), the phosphorus acid ester (C), the base oil (D) and other additives.

Falling within a range not conflicting with the advantageous effects of the present invention, the total content of the additives is not specifically limited but is, in consideration of the effect of the additives to be added, preferably 0.1% by mass or more, more preferably 1% by mass or more, even more preferably 5% by mass or more. The upper limit is preferably 20% by mass or less, more preferably 18% by mass or less, even more preferably 17% by mass or less.

(Viscosity Index Improver)

The lubricating oil composition of the present embodiment may contain a viscosity index improver, for the purpose of improving the viscosity index of the lubricating oil composition. Examples of the viscosity index improver include polymers such as a non-dispersant-type polymethacrylate, a dispersant-type polymethacrylate, an olefin-based copolymer (for example, an ethylene-propylene copolymer), a dispersant-type olefin-based copolymer, and a styrene-based copolymer (for example, a styrene-diene copolymer, a styrene-isoprene copolymer). In the present embodiment, a polymethacrylate is preferred, and a non-dispersant-type polymethacrylate is more preferred.

The mass-average molecular weight of the viscosity index improver may be suitably determined depending on the kind thereof, but is, from the viewpoint of viscosity characteristics, generally 500 or more and 1,000,000 or less, preferably 5,000 or more and 800,000 or less, more preferably 10,000 or more and 600,000 or less.

In the case of a non-dispersant-type or dispersant-type polymethacrylate, the mass-average molecular weight thereof is preferably 5,000 or more and 500,000 or less, more preferably 10,000 or more and 300,000 or less, and further more preferably 20,000 or more and 100,000 or less. In the case of an olefin-based copolymer, the mass-average molecular weight thereof is preferably 800 or more and 300,000 or less, more preferably 10,000 or more and 200,000 or less.

In this description, the mass-average molecular weight is a value derived from the calibration curve drawn through gel permeation chromatography (GPC) using polystyrene. For example, the mass-average molecular weight of each polymer mentioned above may be calculated in terms of a polystyrene according to the GPC method mentioned below.

<GPC Measuring Apparatus>

Column: TOSO GMHHR-H(S)HT

Detector: RI detector for liquid chromatography, WATERS 150C

<Measurement Condition, etc.>

Solvent: 1,2,4-trichlorobenzene

Measurement temperature: 145° C.

Flow rate: 1.0 ml/min

Sample concentration: 2.2 mg/ml

Injection amount: 160 μl

Calibration curve: Universal Calibration

Analysis program: HT-GPC (Ver. 1.0)

The content of the viscosity index improver is, from the viewpoint of viscosity characteristics, preferably 0.5% by mass or more based on the total amount of the composition, more preferably 1% by mass or more, even more preferably 3% by mass or more. The upper limit is preferably 15% by mass or less, more preferably 13% by mass or less, even more preferably 12% by mass or less.

(Friction Modifier)

Examples of the friction modifier include ash-free friction modifiers such as aliphatic amines, aliphatic alcohols, fatty acid amines, fatty acid esters, fatty acid amides, fatty acids and fatty acid ethers having at least one alkyl or alkenyl group having 6 or more and 30 or less carbon atoms, especially a linear alkyl or alkenyl group having 6 or more and 30 or less carbon atoms in the molecule; and molybdenum-based friction modifiers such as molybdenum dithiocarbamate (MoDTC), molybdenum dithiophosphate (MoDTP), and molybdic acid amine salts.

In the case where an ash-free friction modifier is used, the content thereof is preferably 0.01% by mass or more based on the total amount of the composition, more preferably 0.05% by mass or more, even more preferably 0.1% by mass or more. The upper limit is preferably 3% by mass or less, more preferably 2% by mass or less, even more preferably 1.5% by mass or less. In the case where a molybdenum-based friction modifier is used, the content thereof is, based on the total amount of the composition, preferably 60 ppm by mass or more, more preferably 70 ppm by mass or more, even more preferably 80 ppm by mass or more in terms of a molybdenum atom. The upper limit is preferably 1,000 ppm by mass or less, more preferably 900 ppm by mass or less, even more preferably 800 ppm by mass or less. When the content falls within the range, excellent fuel saving performance and anti-wear characteristics can be attained and detergency can be prevented from lowering.

(Anti-Wear Agent)

Examples of the anti-wear agent include sulfur-based anti-wear agents such as metal thiophosphates (examples of metal: zinc (Zn), lead (Pb), antimony (Sb)) and metal thiocarbamates (examples of metal: zinc (Zn)), and phosphorus-based anti-wear agents such as phosphate esters (for example, tricresyl phosphate).

(Dispersant)

Examples of the dispersant include ash-free dispersants such as boron free succinimides, boron-containing succinimides, benzylamines, boron-containing benzylamines, succinates, and mono or dicarboxylic acid amides of typically fatty acids or succinic acid.

(Metal Deactivator)

Examples of the metal deactivator include benzotriazole, triazole derivatives, benzotriazole derivatives, and thiadiazole derivatives.

(Antioxidant)

Examples of the antioxidant include amine-based antioxidants such as diphenylamine-based antioxidants, and naphthylamine-based antioxidants; phenol-based antioxidants such as monophenol-based antioxidants, diphenol-based antioxidants, and hindered phenol-based antioxidants; molybdenum-based antioxidants such as molybdenum amine complexes produced by reacting molybdenum trioxide and/or molybdic acid and an amine compound; sulfur-based antioxidants such as phenothiazine, dioctadecyl sulfide, dilauryl-3,3'-thiodipropionate, and 2-mercaptobenzimidazole; and phosphorus-based antioxidants such as triphenyl phosphite, diisopropylmonophenyl phosphite, and monobutyldiphenyl phosphite.

(Pour Point Depressant)

Examples of the pour point depressant include ethylene-vinyl acetate copolymers, condensation products of chloroparaffin and naphthalene, condensation products of chloroparaffin and phenol, polymethacrylates, and polyalkylstyrenes.

(Anti-Foaming Agent)

Examples of the anti-foaming agent include silicone oils, fluorosilicone oils, and fluoroalkyl ethers.

(Various Physical Properties of Lubricating Oil Composition)

The kinematic viscosity at 100° C. of the lubricating oil composition of the present embodiment is preferably 1 $mm^2/s$ or more, more preferably 2 $mm^2/s$ or more, even more preferably 4 $mm^2/s$ or more. The upper limit is preferably 10 $mm^2/s$ or less, more preferably 8 $mm^2$ is or less, even more preferably 7 $mm^2/s$ or less. The kinematic viscosity at 40° C. of the lubricating oil composition of the present embodiment is preferably 7 $mm^2/s$ or more, more preferably 10 $mm^2/s$ or more, even more preferably 15 $mm^2/s$ or more. The upper limit is preferably 30 $mm^2/s$ or less, more preferably 27 $mm^2/s$ or less, even more preferably 25 $mm^2/s$ or less. When the kinematic viscosity of the lubricating oil composition falls within the above range, fuel saving performance may be bettered, a high intermetallic friction coefficient and excellent clutch anti-shudder performance can be attained and, in addition, a sufficient oil film may be formed on a slide surface to prevent machines from being worn owing to oil film shortage.

Also from the same viewpoint as above, the viscosity index of the lubricating oil composition of the present embodiment is preferably 150 or more, more preferably 170 or more, even more preferably 190 or more.

The intermetallic friction coefficient of the lubricating oil composition of the present embodiment is preferably 0.11 or more, more preferably 0.113 or more, even more preferably 0.115 or more. In this description, the intermetallic friction coefficient is a value measured according to the method described in the section of Examples given hereinunder.

The initial clutch anti-shudder performance of the lubricating oil composition of the present embodiment is preferably 0.08 or more, more preferably 0.085 or more, even more preferably 0.09 or more. In this description, the value of initial clutch anti-shudder performance is a value measured according to the method described in the section of Examples given hereinunder.

The clutch anti-shudder lifetime of the lubricating oil composition of the present embodiment, is preferably 380 hours or more, more preferably 400 hours or more, even more preferably 450 hours or more, and especially preferably 500 hours or more. The clutch anti-shudder lifetime is a value measured according to the method described in the section of Examples given hereinunder.

As described above, the lubricating oil composition of the present embodiment has a high intermetallic friction coefficient and is excellent in clutch anti-shudder performance.

Taking advantage of such characteristic properties thereof, the lubricating oil composition of the present embodiment can be favorably used as a lubricating oil composition for transmissions, for example, for manual transmissions, automatic transmissions or continuously variable transmissions to be mounted on gasoline vehicles, hybrid vehicles, electric vehicles and the like. In particular, the lubricating oil composition of the present embodiment is favorable as a lubricating oil composition for continuously variable transmissions equipped with a lock-up clutch often to cause shudder generation, which requires high-capacity power transmission by the friction coefficient between a belt or a chain and a pulley, and undergoes slip control for power transmission with slipping in addition to direct fastening. In addition, the lubricating oil composition of the present embodiment may be favorably used for other uses, for example, for internal combustion engines, hydraulic machines, turbines, compressors, working machines, cutting machines, gears, and machines equipped with liquid bearings or ball bearings.

[Lubrication Method and Transmission]

The lubrication method of the present embodiment is a lubrication method using the lubricating oil composition of this embodiment described above. The lubricating oil composition for use in the lubrication method of the present embodiment has a high intermetallic friction coefficient and is excellent in clutch anti-shudder performance. Accordingly, the lubrication method of the present embodiment is favorably used for transmissions such as manual transmissions, automatic transmissions or continuously variable transmissions to be mounted, for example, on gasoline vehicles, hybrid vehicles and electric vehicles, and in particular, the lubrication method is favorably used for lubrication in continuously variable transmissions. In addition, the lubrication method is also favorably used for other uses, for example, for lubrication of internal combustion engines, hydraulic machines, turbines, compressors, working machines, cutting machines, gears, and machines equipped with liquid bearings or ball bearings.

The transmission of the present embodiment uses the lubricating oil composition of the present embodiment. The transmission of the present embodiment uses the lubricating oil composition having a high intermetallic friction coefficient and excellent in clutch anti-shudder performance, and is therefore widely favorably applied to various vehicles such as gasoline vehicles, hybrid vehicles and electric vehicles.

EXAMPLES

Next, the present invention is described in more detail with reference to Examples, but the present invention is not limited at all by these Examples.

Examples 1 to 3, Comparative Examples 1 to 8

Lubricating oil compositions were prepared at the blending ratio (% by mass) shown in Table 1 and Table 2. The resultant lubricating oil compositions were tested variously according to the methods mentioned below to evaluate the properties thereof. The evaluation results are shown in Table 1 and Table 2.

The properties of the lubricating oil compositions were measured and evaluated according to the methods mentioned below.

(1) Kinematic Viscosity

Kinematic viscosity at 40° C. and 100° C. was measured according to JIS K 2283:2000.

(2) Viscosity Index (VI)

Measured according to JIS K 2283:2000.

(3) Content of Nitrogen Atom

Measured according to JIS K 2609:1998.

(4) Content of Metal Atom

Measured according to JIS-5S-38-92.

(5) Content of Phosphorus Atom

Measured according to JIS-5S-38-92.

(6) Measurement of Intermetallic Friction Coefficient: LFW-1 Test

Using a block-on-ring tester (LFW-1) described in ASTM D2174, intermetallic friction coefficient was measured. Concrete test conditions are as follows.

Test Tool:

Ring: Falex S-10 Test Ring (SAE4620 Steel)

Block: Falex H-60 Test Block (SAE01 Steel)

Test Conditions:

Oil temperature: 110° C.

Load: 1176 N

Slip rate: At 1.0, 0.5, 0.25, 0.125 and 0.063 m/s in that order, the tool was maintained as such for 5 minutes.

Friction coefficient: Value measured for 30 seconds before change of slip rate.

(Preconditioning: oil temperature, 110° C.; load, 1176 N: slip rate, 1 m/s; time, 30 minutes)

(7) Initial Dutch Anti-Shudder Performance

According to JASO M349-2012, samples were tested under the following conditions, and the value of $d\mu/dV$ at 50 rpm is referred to as an index of initial clutch anti-shudder performance. A larger value means more excellent initial anti-shudder performance.

Friction material: cellulosic disc steel plate

Oil amount: 150 mL

Performance measurement: Measured at oil temperature 40° C. after preconditioning operation.

(Preconditiong operation: oil temperature, 80° C.; surface pressure, 1 MPa; slip rate, 0.6 m/s; time, 30 minutes)

(8) Clutch Anti-Shudder Lifetime

Evaluated according to JASO M349-2012. Concrete test conditions are as follows.

Friction material: cellulosic disc/steel plate

Oil amount: 150 mL

Oil temperature: 120° C.

Slip rate: 0.9 m/s

Slip time: 30 minutes

Downtime: 1 minute

Performance measurement: At intervals of 24 hours after the start of the test, μ-V characteristics were measured, and the time taken until the value of $d\mu/dV$ reached less than 0 at 80° C. was counted to be the clutch anti-shudder lifetime of the tested sample.

(Preconditioning operation: oil temperature, 80° C.; surface pressure, 1 MPa; slip rate, 0.6 m/s; time, 30 minutes)

TABLE 1

| | Example | | |
|---|---|---|---|
| | 1 | 2 | 3 |
| Amide Compound (A) (% by mass) | 1 | 1 | 1 |
| Metal-based Detergent 1 (B) (% by mass) | 0.4 | 0.4 | — |
| Metal-based Detergent 2 (B) (% by mass) | — | — | 0.5 |
| Acid Phosphite Ester (C) (% by mass) | 0.25 | — | 0.25 |
| Acid Phosphate Ester (C) (% by mass) | — | 0.25 | — |
| Base Oil (D) (% by mass) | balance | balance | balance |
| Amine Compound 1 (% by mass) | — | — | — |
| Amine Compound 2 (% by mass) | — | — | — |
| Amine Compound 3 (% by mass) | — | — | — |
| Other Additives (% by mass) | 15 | 15 | 15 |
| Total (% by mass) | 100 | 100 | 100 |
| Nitrogen Content: derived from (A) (ppm by mass) | 400 | 400 | 400 |
| Metal Content: derived from (B) (ppm by mass) | 600 | 600 | 600 |
| Phosphorus Content: derived from (C) (ppm by mass) | 400 | 370 | 400 |
| Kinematic Viscosity at 100° C. ($mm^2/s$) | 5.5 | 5.5 | 5.5 |
| Kinematic Viscosity at 40° C. ($mm^2/s$) | 22 | 22 | 22 |
| Viscosity Index | 205 | 205 | 205 |
| Intermetallic Friction Coefficient | 0.123 | 0.122 | 0.120 |
| Initial Clutch Anti-Shudder Performance | 0.095 | 0.095 | 0.091 |
| Clutch Anti-Shudder Lifetime | 576 | 564 | 588 |

Metal-based detergent 1: metal-based detergent (B), calcium sulfonate (base number: 450 mgKOH/g, calcium content: 15% by mass, sulfur content: 1% by mass)

Metal-based detergent 2: metal-based detergent (B), calcium sultanate (base number: 300 mgKOH/g, calcium content: 12% by mass, sulfur content: 3% by mass)

Acid phosphite ester: phosphorus acid ester (C), 2-ethylhexyl hydrogenphosphite

Acid phosphate ester: phosphorus acid ester (C), 2-ethylhexyl acid phosphate ester Amine compound 1: oleylamine Amine compound 2: stearylpropylenediamine Amine compound 3: dimethyloctadecylamine Other additives: viscosity index improver (non-dispersant-type polymethacrylate, mass-average molecular weight: 30,000), anti-wear agent (tricresyl phosphate ester), friction modifier (fatty acid ester), dispersant (polybutenylsuccinimide), anti-wear agent (sulfur-based anti-wear agent), metal deactivator (thiadiazole-based metal deactivator), anti-foaming agent (silicone-based anti-foaming agent)

From the results in Table 1, it is confirmed that the lubricating oil compositions of Examples 1 to 3 have a high intermetallic friction coefficient and are excellent in clutch anti-shudder performance. On the other hand, it is confirmed that the lubricating oil composition of Comparative Example 1 not containing the amide compound (A) is poor in initial clutch anti-shudder performance and has an extremely short clutch anti-shudder lifetime, and that the lubricating oil composition of Comparative Example 2 not containing the metal-based detergent (B) and the lubricating oil composition of Comparative Example 3 not containing the phosphorus acid ester (C) have a low intermetallic friction coefficient, and could not satisfy both the requirements of high intermetallic friction coefficient and excellent clutch anti-shudder performance. The lubricating oil compositions of Comparative Examples 4 to 6 do not contain the amide compound (A) but in place of it, an amine compound was blended therein; however, the amine compound did not specifically exhibit the effect of improving clutch anti-shudder lifetime. The lubricating oil composition of Comparative Example 7 not containing the amide compound (A) and the metal-based detergent (B) but containing, in place of

TABLE 2

| | Comparative Example | | | | | | | |
|---|---|---|---|---|---|---|---|---|
| | 1 | 2 | 3 | 4 | 5 | 6 | 7 | 8 |
| Amide Compound (A) (% by mass) | — | 1 | 1 | — | — | — | — | — |
| Metal-based Detergent 1 (B) (% by mass) | 0.4 | — | 0.4 | 0.4 | 0.4 | 0.4 | — | 0.4 |
| Metal-based Detergent 2 (B) (% by mass) | — | — | — | — | — | — | — | — |
| Acid Phosphite Ester (C) (% by mass) | 0.25 | 0.25 | — | 0.25 | 0.25 | — | 0.25 | — |
| Acid Phosphate Ester ((C) % by mass) | — | — | — | — | — | 0.25 | — | — |
| Base Oil (D) (% by mass) | balance | balance | balance | balance | balance | balance | balance | balance |
| Amine Compound 1 (% by mass) | — | — | — | 0.05 | — | 0.05 | — | 0.05 |
| Amine Compound 2 (% by mass) | — | — | — | — | 0.03 | — | — | — |
| Amine Compound 3 (% by mass) | — | — | — | 0.4 | 0.4 | 0.4 | 0.4 | 0.4 |
| Other Additives (% by mass) | 15 | 15 | 15 | 15 | 15 | 15 | 15 | 15 |
| Total (% by mass) | 100 | 100 | 100 | 100 | 100 | 100 | 100 | 100 |
| Nitrogen Content: derived from (A) (ppm by mass) | 0 | 400 | 400 | 0 | 0 | 0 | 0 | 0 |
| Metal Content: derived from (B) (ppm by mass) | 600 | 0 | 600 | 600 | 600 | 600 | 0 | 600 |
| Phosphorus Content: derived from (C) (ppm by mass) | 400 | 400 | 0 | 400 | 400 | 370 | 400 | 0 |
| Kinematic Viscosity at 100° C. ($mm^2/s$) | 5.5 | 5.5 | 5.5 | 5.5 | 5.5 | 5.5 | 5.5 | 5.5 |
| Kinematic Viscosity at 40° C. ($mm^2/s$) | 22 | 22 | 22 | 22 | 22 | 22 | 22 | 22 |
| Viscosity Index | 205 | 205 | 205 | 205 | 205 | 205 | 205 | 205 |
| Intermetallic Friction Coefficient | 0.122 | 0.105 | 0.108 | 0.122 | 0.121 | 0.122 | 0.108 | 0.109 |
| Initial Clutch Anti-Shudder Performance | 0.087 | 0.097 | 0.091 | 0.096 | 0.097 | 0.096 | 0.088 | 0.092 |
| Clutch Anti-Shudder Lifetime | 48 | 624 | 564 | 348 | 348 | 336 | 312 | 312 |

Details of the components shown in Table 1 and Table 2 used in these Examples are as follows.

Base oil: base oil (D), 70 N mineral oil, kinematic viscosity at 40° C. 12.5 $mm^2/s$, kinematic viscosity at 100° C. 3.1 $mm^2/s$, viscosity index 110

Amide compound; amide compound (A), an amide compound having, as $R^1$ and $R^2$, at least a dodecyl group, a tetradecyl group, a decyl group, a hexadecyl group, an octadecyl group and an octadecenyl group, in which the content of each group relative to all $R^1$'s and $R^2$'s 61% by mass, 19% by mass, 5.5% by mass, 7% by mass, 2% by mass and 3.5% by mass, respectively, and having a hydroxymethyl group as $R^3$. The amide compound is a reaction product of a secondary amine derived from coconut having $R^1$ and $R^2$ (dicocoalkylamine) and glycolic acid.

these, an amine compound blended therein had a low intermetallic friction coefficient, was poor in initial clutch anti-shudder performance, and could not exhibit the effect of improving clutch anti-shudder lifetime. Also the lubricating oil composition of Comparative Example 8 not containing the amide compound (A) and the phosphorus acid ester (C) but containing, in place of these, an amine compound blended therein had a low intermetallic friction coefficient and could not exhibit the effect of improving clutch anti-shudder lifetime.

INDUSTRIAL APPLICABILITY

The lubricating oil composition of the present embodiment has a high intermetallic friction coefficient and is excellent in clutch anti-shudder performance. Accordingly, for example, the lubricating oil composition can be favorably used for transmissions such as manual transmissions, automatic transmissions or continuously variable transmissions to be mounted on gasoline vehicles, hybrid vehicles, electric vehicles and the like. In particular, the lubricating oil composition is favorably used for continuously variable transmissions equipped with a lock-up clutch often to cause shudder generation, which requires high-capacity power transmission by the friction coefficient between a belt or a chain and a pulley, and undergoes slip control for power transmission with slipping in addition to direct fastening.

The invention claimed is:

1. A lubricating oil composition, comprising:

(A) an amide compound (A) represented by formula (I):

(I)

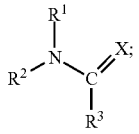

(B) from 0.2% by mass to 2% by mass of a metal-based detergent (B) which is at least one selected from the group consisting of an alkaline earth metal sulfonate, an alkaline earth metal phenate and an alkaline earth metal salicylate; and (C) from 0.15% by mass to 2% by mass of at least one phosphorus acid ester (C) selected from an acid phosphate ester of formula (II) and an acid phosphite ester of formula (IV);

(II)

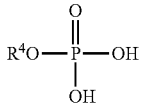

(IV)

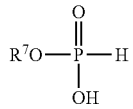

wherein $R^4$ and R7 each independently represent an alkyl group or an alkenyl group having 6 or more and 14 or less carbon atoms;

wherein:

a content of hydrocarbon group having 12 carbon atoms as $R^1$ and $R^2$ in all $R^1$'s and $R^2$'s contained in the amide compound is 30% by mass or more and 75% by mass or less, and a content of hydrocarbon group having 14 carbon atoms as $R^1$ and $R^2$ in all $R^1$'s and $R^2$'s contained in the amide compound is 5% by mass or more and 40% by mass or less;

$R^1$ and $R^2$ each independently represent a hydrocarbon group having 6 or more carbon atoms;

$R^3$ represents a hydroxyalkyl group having 1 or more and 6 or less carbon atoms, or a group formed through condensation of the hydroxyalkyl group and an acylating agent;

X represents an oxygen atom or a sulfur atom; and the amide compound (A) is present in an amount from 0.1% by mass to 2% by mass, based on the total amount of the composition.

2. The lubricating oil composition according to claim 1, wherein, in all $R^1$'s and $R^2$'s contained in the amide compound, a content of a dodecyl group is 30% by mass or more and 75% by mass or less, and a content of a tetradecyl group is 5% by mass or more and 40% by mass or less.

3. The lubricating oil composition according to claim 1, wherein:

$R^1$ and $R^2$ contained in the amide compound (A) comprise a dodecyl group, a tetradecyl group and at least one selected from the group consisting of an octyl group, a decyl group, a hexadecyl group, an octadecyl group and an octadecenyl group; and, in all $R^1$'s and $R^2$'s contained in the amide compound, a content of the dodecyl group is 30% by mass or more and 75% by mass or less, a content of the tetradecyl group is 5% by mass or more and 40% by mass or less, and a content of the at least one selected from the group consisting of the octyl group, the decyl group, the hexadecyl group, the octadecyl group and the octadecenyl group is 1% by mass or more and 20% by mass or less.

4. The lubricating oil composition according to claim 1, wherein:

$R^1$ and $R^2$ each are an alkyl group having 6 or more and 24 or less carbon atoms;

$R^3$ is a hydroxyalkyl group having 1 or more and 2 or less carbon atoms; and

X is an oxygen atom.

5. The lubricating oil composition according to claim 1, wherein the amide compound (A) is a reaction product formed from a vegetable-derived secondary amine comprising a dodecyl group in an amount of 30% by mass or more and 75% by mass or less, a tetradecyl group in an amount of 5% by mass or more and 40% by mass or less, and at least one selected from an octyl group, a decyl group, a hexadecyl group, an octadecyl group and an octadecenyl group in an amount of 1% by mass or more and 20% by mass or less.

6. The lubricating oil composition according to claim 1, wherein a nitrogen content derived from the amide compound (A) is 100 ppm by mass or more based on a total amount of the composition.

7. The lubricating oil composition according to claim 1, wherein a base number of the metal-based detergent (B) is 10 mgKOH/g or more and 700 mgKOH/g or less.

8. The lubricating oil composition according to claim 1, wherein a metal content derived from the metal-based detergent (B) is 10 ppm by mass or more and 1,000 ppm by mass or less based on a total amount of the composition.

9. The lubricating oil composition according to claim 1, wherein a phosphorus content derived from the phosphorus acid ester (C) is 100 ppm by mass or more based on the total amount of the composition.

10. The lubricating oil composition according to claim 1, which is adapted to function as a lubricating oil composition for transmissions.

11. The lubricating oil composition according to claim 1, which is adapted to function as a lubricating oil composition for continuously variable transmissions.

12. A lubrication method, comprising lubricating a device with the lubricating oil composition of claim 1.

13. A transmission, comprising the lubricating oil composition of claim 1.

14. The lubricating oil composition according to claim 1, wherein:

the amide compound (A) is present in an amount from 0.5% by mass to 2% by mass, based on the total amount of the composition; and a phosphorus content derived from the phosphorus acid ester (C) is from 200-1,000 ppm by mass based on the total amount of the composition.

* * * * *